US009156264B2

(12) United States Patent
Taira et al.

(10) Patent No.: US 9,156,264 B2
(45) Date of Patent: Oct. 13, 2015

(54) IMAGE RECORDING APPARATUS

(75) Inventors: Hiroshi Taira, Ichinomiya (JP); Tadanobu Chikamoto, Nagoya (JP); Shuichi Tamaki, Nagoya (JP); Akira Shinoda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 162 days.

(21) Appl. No.: 13/244,212

(22) Filed: Sep. 23, 2011

(65) Prior Publication Data

US 2012/0013681 A1 Jan. 19, 2012

Related U.S. Application Data

(62) Division of application No. 12/359,894, filed on Jan. 26, 2009, now abandoned.

(30) Foreign Application Priority Data

Jan. 29, 2008 (JP) ..... 2008-017146

(51) Int. Cl.
*B41J 2/165* (2006.01)
*B41J 2/155* (2006.01)

(52) U.S. Cl.
CPC ..... *B41J 2/155* (2013.01); *B41J 2/16585* (2013.01); *B41J 2202/19* (2013.01); *B41J 2202/20* (2013.01)

(58) Field of Classification Search
None
See application file for complete search history.

(56) References Cited

U.S. PATENT DOCUMENTS 6,260,943 B1 * 7/2001 Ishikawa ..... 347/32
2006/0103690 A1 * 5/2006 Katayama ..... 347/29
2008/0309702 A1 12/2008 Takahashi

FOREIGN PATENT DOCUMENTS

| | | | |
|---|---|---|---|
| JP | H05-318753 | A | 12/1993 |
| JP | H06-336019 | A | 12/1994 |
| JP | 2000-211148 | A | 8/2000 |
| JP | 2003-159822 | A | 6/2003 |
| JP | 2004-034478 | A | 2/2004 |

(Continued)

OTHER PUBLICATIONS

Japan Patent Office, Notification of Reason for Refusal for Japanese Patent Application No. 2008-017146 (counterpart to above-captioned patent application), mailed Oct. 25, 2011.

(Continued)

*Primary Examiner* — Alejandro Valencia
(74) *Attorney, Agent, or Firm* — Baker Botts L.L.P.

(57) ABSTRACT

An image recording apparatus including: (a) a head assembly including (a-1) recording heads having respective nozzle opening surfaces and (a-2) a head frame supporting the recording heads; (b) annular protrusions each of which is to be brought into contact with the head assembly, so as to surround the plurality of nozzles opening in the corresponding nozzle opening surface; (c) a supporting tray elongated in a supporting-tray longitudinal direction and supporting the annular protrusions; (d) a movement mechanism configured to move the head assembly and/or the supporting tray, and (e) a positioning pin projecting from a pin-located portion of the supporting tray. The pin-located portion is outside the annular protrusions, and is located in a center of the supporting tray in the supporting-tray longitudinal direction. The head frame has a positioning hole, into which the positioning pin is to be introduced upon contact of each annular protrusion with the head assembly.

17 Claims, 7 Drawing Sheets

(56) References Cited

FOREIGN PATENT DOCUMENTS

| | | | |
|---|---|---|---|
| JP | 2004-122423 | A | 4/2004 |
| JP | 2005-007253 | A | 1/2005 |
| JP | 2005-111938 | A | 4/2005 |
| JP | 2006-212864 | A | 8/2006 |
| JP | 2007-216466 | A | 8/2007 |

OTHER PUBLICATIONS

Japan Patent Office, Decision to Grant a Patent for Japanese Patent Application No. 2008-017146 (counterpart to above-captioned patent application), dispatched Jan. 17, 2012.

* cited by examiner

IMAGE RECORDING APPARATUS

CROSS REFERENCE TO RELATED APPLICATION

This application is a divisional application of U.S. patent application Ser. No. 12/359,894, filed on Jan. 26, 2009, which claims the benefit of Japanese Patent Application No. 2008-017146, filed on Jan. 29, 2008, the disclosures of which are incorporated herein by reference in their entirety.

BACKGROUND OF THE DISCLOSURE

1. Field of the Disclosure

The features herein relate to an image recording apparatus configured to record an image on a recording medium by ejecting droplets onto the recording medium.

2. Description of Related Art

As an inkjet printer for recording an image on a recording medium such as recording sheet, by ejecting ink droplets onto the recording medium, there is an inkjet printer including an inkjet recording head having a nozzle opening surface in which a plurality of nozzles open such that the ink droplets can be ejected through the nozzles toward the recording medium. In such an inkjet recording head, the recording head could suffer from poor ejection performance due to, for example, entrance of paper powder into the nozzles and considerable increase of viscosity of ink in the nozzles. Meanwhile, there is known technique for sealing the nozzle opening surface with a cap unit during non-use of the printer, for preventing deterioration of the ejection performance of the recording head.

Where the inkjet printer is line-type, a plurality of large-sized inkjet recording heads are employed. In such a case, the plurality of recording heads have respective nozzle opening surfaces requiring a large-sized cap unit that are arranged to seal the nozzle opening surfaces. Since the size of the required cap unit is inevitably large, it is difficult to maintain accuracy of positioning the cap unit and accordingly difficult to reliably seal the nozzle opening surfaces. For increasing the accuracy of positioning the cap unit, the cap unit and a mechanism for moving the cap unit would require complicated constructions.

SUMMARY OF THE INVENTION

A need has arisen for an image recording apparatus capable of reliably sealing nozzle opening surfaces with a simplified construction for sealing the nozzle opening surfaces.

According to one embodiment herein, an image recording apparatus for recording an image on a recording medium by ejecting droplets onto the recording medium, the apparatus may include: (a) a head assembly including (a-1) a plurality of recording heads having respective nozzle opening surfaces in each of which a plurality of nozzles open such that the droplets can be ejected through the nozzles toward the recording medium, and (a-2) a head frame supporting the recording heads; (b) a plurality of annular protrusions each of which is to be brought into contact with the head assembly, so as to surround the plurality of nozzles opening in a corresponding one of the nozzle opening surfaces exposed in the head frame, upon contact of each of the annular protrusions with the head assembly; (c) a supporting tray elongated in a supporting-tray longitudinal direction and supporting the annular protrusions; (d) a movement mechanism configured to move at least one of the head assembly and the supporting tray, so as to selectively establish a contact state in which the annular protrusions are in contact with the head assembly and a non-contact state in which the annular protrusions are not in contact with the head assembly; and (e) a positioning pin projecting from a pin-located portion of the supporting tray, in a direction perpendicular to an opening surface plane that contains the nozzle opening surfaces, wherein the pin-located portion of the supporting tray is outside the annular protrusions that are disposed on the supporting tray, and is located in a center of the supporting tray in the supporting-tray longitudinal direction, and wherein the head frame has a positioning hole, into which the positioning pin is to be introduced upon contact of each of the annular protrusions with the head assembly.

In the image recording apparatus, the supporting tray supports the plurality of annular protrusions, and the annular protrusions supported by the supporting tray are accurately positioned, by the positioning pin, relative to the head frame. Therefore, the plurality of annular protrusions can be positioned relative to the head frame with an increased positioning accuracy, so that the plurality of nozzle opening in each of the nozzle opening surfaces can be accurately surrounded by a corresponding one of the annular protrusions. Thus, it is possible to accurately position the annular protrusions so as to reliably seal the plurality of nozzle opening surfaces, with a simplified construction for sealing the nozzle opening surfaces. It is noted that each of the annular protrusions may be arranged to be brought into contact with either the head frame or a corresponding one of the nozzle opening surfaces, so as to surround the nozzles opening in the corresponding nozzle opening surface.

BRIEF DESCRIPTION OF THE DRAWINGS

The above and other objects, features, advantages and technical and industrial significance of the embodiments of the image recording apparatus will be better understood by reading the following detailed description of presently preferred embodiment of the invention, when considered in connection with the accompanying drawings, in which.

DETAILED DESCRIPTION OF THE PREFERRED EMBODIMENTS

There will be described embodiments of the image recording apparatus, by reference to the accompanying drawings.

Figure 1:
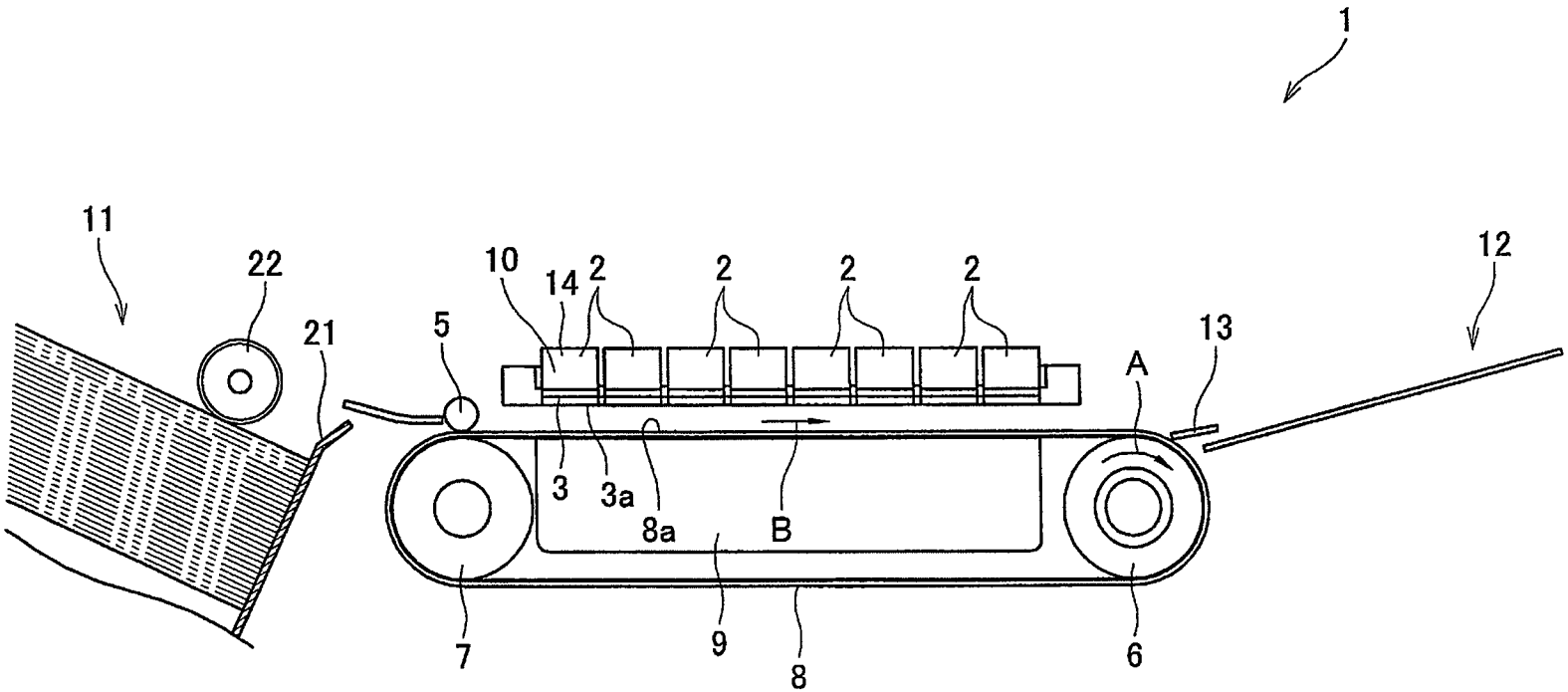
FIG. 1 is a side view showing an inkjet printer according to an embodiment.

FIG. 1 shows an image recording apparatus in the form of a color inkjet printer 1 having a total of eight inkjet heads 2 as recording heads. In the inkjet printer 1, a sheet supplier 11 and a sheet exit portion 12 are provided in a left-side portion and a right-side portion, respectively, as seen in FIG. 1.

In the inkjet printer 1, there is defined a sheet conveyor path along which paper sheets as recording media are to be conveyed from the sheet supplier 11 to the sheet exit portion 12. The sheet supplier 11 has a pickup roller 22 that is configured to pick up an uppermost one of the plurality of paper sheets accommodated in a sheet tray 21, so that the paper sheets are conveyed one after another in a rightward direction as seen in FIG. 1. In an intermediate portion of the sheet conveyor path, there are disposed a drive pulley 6, a driven roller 7 and a conveyor belt 8. The conveyor belt 8 is stretched around the two pulleys 6, 7 so as to interconnect the two pulleys 6, 7 that are distant from each other. The conveyor belt 8 has an outer circumferential surface which is coated with a silicon coating so as to have stickiness and which serves as a conveyor surface 8*a*. On an immediately downstream side of the sheet supplier 11, a presser roller 5 is provided to be positioned in a position that is opposed to the conveyor belt 8, so that the paper sheet supplied from the sheet supplier 11 is pressed, by the presser roller 5, against the conveyor surface 8*a* of the conveyor belt 8. The paper sheet pressed against the conveyor surface 8*a* is conveyed in a downstream direction (i.e., in the rightward direction as seen in FIG. 1), while being held by the conveyor surface 8*a* owing to the stickiness. In this instance, a drive force is transmitted from a drive motor (not shown) to the drive pulley 6 that is positioned on a downstream side of the driven pulley 7, and the drive pulley 6 is rotated in a clockwise direction (indicated by arrow A) as seen in FIG. 1.

In an image recording operation performed by the inkjet printer 1, an image is recorded on the paper sheet in an image recording region of the intermediate portion of the sheet conveyor path, which region is opposed to the plurality of inkjet heads 2. A sheet separator plate 13 is provided along the sheet conveyor path, and is positioned on an immediately downstream side of the conveyor belt 8. The separator plate 13 is configured to separate the paper sheet (that is held on the conveyor surface 8*a* of the conveyor belt 8), from the conveyor surface 8*a*, such that the separated paper sheet is conveyed to the sheet exit portion 12 that is located on a downstream side of the separator plate 13.

In a region surrounded by the conveyor belt 8, a platen 9 having a generally rectangular parallelepiped shape is disposed to be positioned in a position that is opposed to the inkjet heads 2. The platen 9 is in contact with an inner circumferential surface of the conveyor belt 8, so as to support the conveyor belt 8. Owing to this arrangement, the conveyed paper sheet can be opposed to the inkjet heads 2 with a predetermined amount of clearance between the paper sheet and the inkjet heads 2, when being positioned in the image recording region, so that the image can be recorded on the paper sheet with a desired quality of the image.

Figure 2:
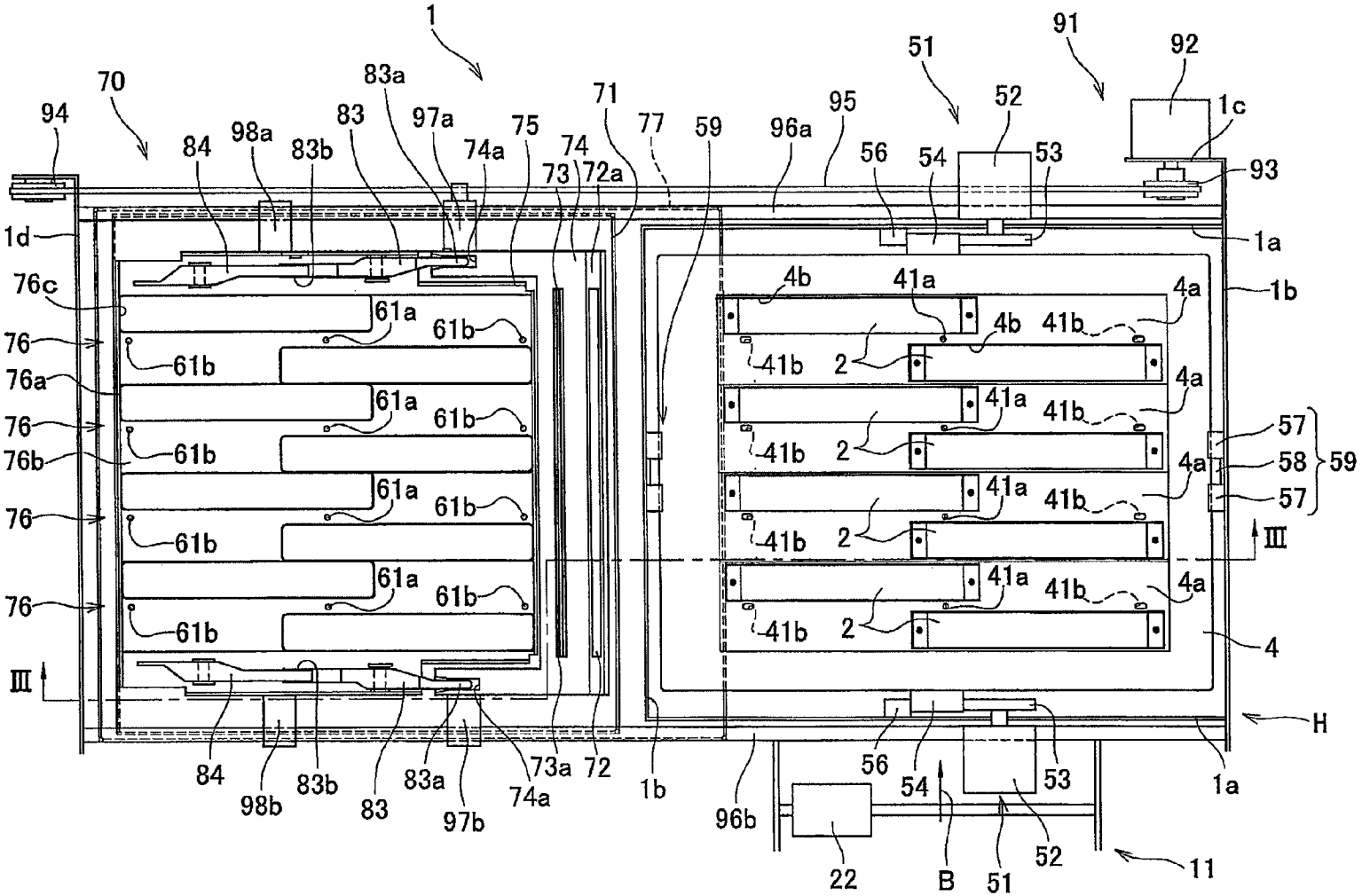
FIG. 2 is a plan view showing a main portion of the inkjet printer.
Figure 3:
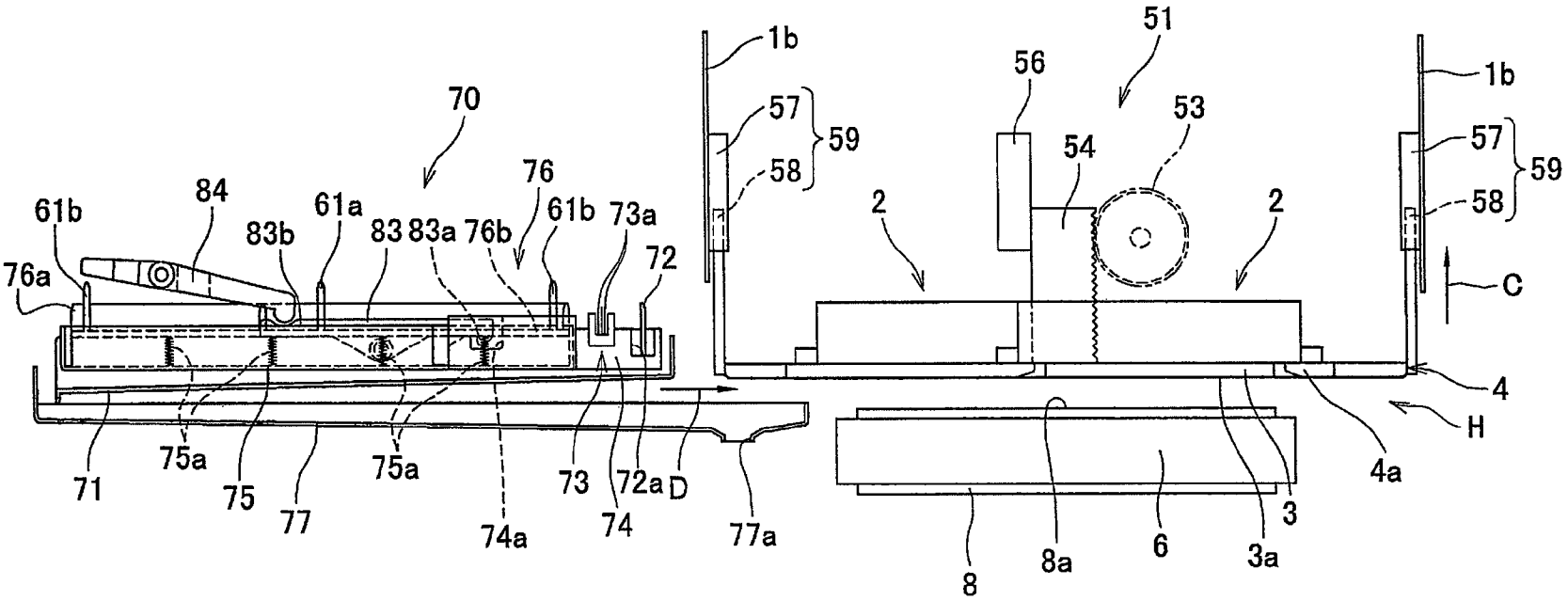
FIG. 3 is a cross sectional view taken along line of FIG. 2.

As shown in FIG. 2, the eight inkjet heads 2 are arranged in two rows that extend in parallel to a sheet conveying direction B (i.e., an upward direction as seen in FIG. 2). More specifically, four of the eight inkjet heads 2 are arranged in a right-side one (as seen in FIG. 2) of the two rows while the other four inkjet heads 2 are arranged in a left-side one of the two rows such that the eight inkjet heads 2 are arranged in a zigzag pattern or in a staggered fashion. Hereinafter, the four inkjet heads 2 arranged in the right-side row will be referred to as right-side inkjet heads 2 while the other four inkjet heads 2 arranged in the left-side row will be referred to as left-side inkjet heads 2. The eight inkjet heads 2 forms four pairs of the inkjet heads 2 which are arranged in the sheet conveying direction B, and each of the four pairs is constituted by a corresponding one of the four right-side inkjet heads 2 and a corresponding one of the four left-side inkjet heads 2, which are adjacent to each other. The four pairs of the inkjet heads 2 are assigned to respective four ink colors (magenta, yellow, cyan, black) that are different from one another, such that ink droplets of one of the four colors can be ejected from a corresponding pair of the inkjet heads 2. The two inkjet heads 2, which constitute each pair of the inkjet heads 2, partially overlap with each other as seen in the sheet conveying direction B, and are adjacent to each other in the sheet conveying direction B. As shown in FIG. 2, each of the inkjet heads 2 has a rectangular parallelepiped shape, and is elongated in a direction perpendicular to the sheet conveying direction B. As shown in FIGS. 1 and 3, each of the inkjet heads 2 has a main body 3 which is provided by a laminar structure including an ink-passage definer unit and an actuator unit. The ink-passage definer unit defines therein ink passages (including pressure chambers), while the actuator unit is configured to pressurize ink stored in pressure chambers. The ink-passage definer unit and the actuator unit are bonded to each other, so as to constitute the main body 3.

Figure 4:
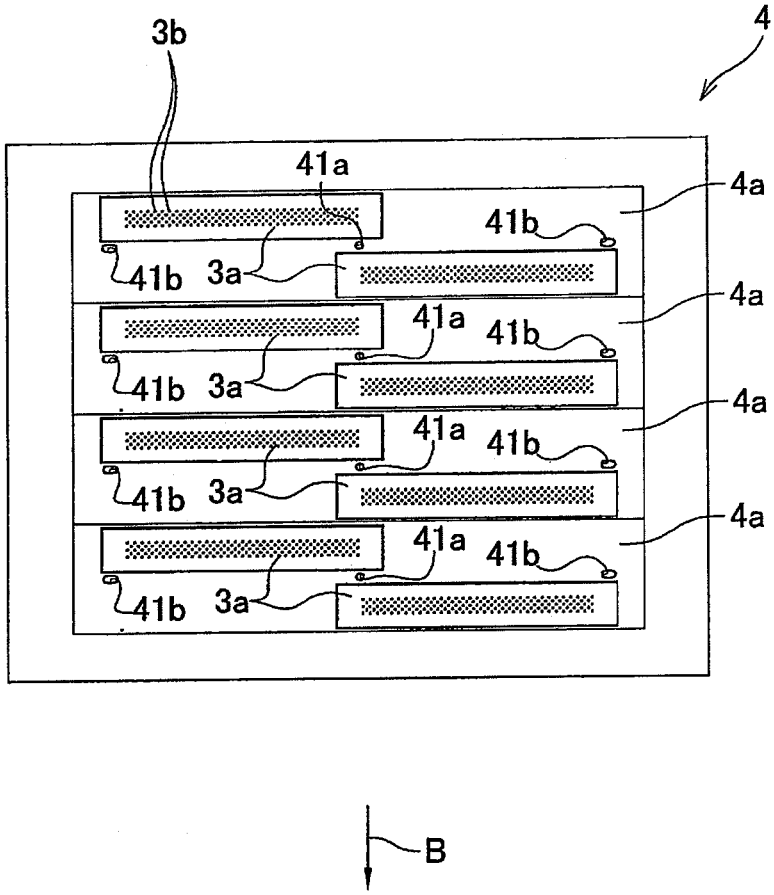
FIG. 4 is a lower plan view of eight inkjet recording heads of the inkjet printer.

Onto an upper surface of the main body 3 of each inkjet head 2, there is fixed a reservoir unit 10 for provisionally reserving the ink. The reservoir unit 10 is partially covered by a cover 14, and defines therein an ink reservoir configured to reserve the ink that is supplied from an ink tank (not shown). The ink reserved in the ink reservoir of the reservoir unit 10 is supplied to the ink passages (not shown) defined in the ink-passage definer unit. The ink passages are held in communication with a multiplicity of nozzles (ejection openings) 3*b* opening in a nozzle opening region that is provided by a non-peripheral portion of a nozzle opening surface 3*a* of the main body 3 of each inkjet head 2, as shown in FIG. 4. The nozzle opening surface 3*a* including the nozzle opening region is opposed to the conveyor surface 8*a*, and is coated with a water-repellent layer (not shown) for preventing surplus ink from sticking to peripheries of openings of the nozzles 3*b*.

The main body 3 of each inkjet head 2 is positioned relative to the conveyor belt 8, such that the nozzle opening surface 3*a* and the conveyor surface 8*a* are parallel to each other with a small amount of clearance therebetween. This small amount of clearance constitutes a part of the above-described sheet conveyor path. When the conveyed paper sheet is passing right below the main bodies 3 of the respective eight inkjet heads 2, the ink droplets of the four colors are ejected through the nozzles 3*b* toward an upper surface (i.e., print surface) of the paper sheet whereby a desired color image is recorded on the upper surface of the paper sheet.

As shown in FIGS. 2 and 4, a total of four head frames 4*a* are fixed to a frame 4, and are arranged in the sheet conveying direction B. Each of the head frames 4*a* is provided by a rectangular-shaped plate member, and supports corresponding two of the eighth inkjet heads 2, i.e., a corresponding one of the four pairs of the inkjet heads 2. Each head frame 4*a* has two rectangular-shaped through-holes 4*b* that are elongated in a main scanning direction of the printer 1 (i.e., a direction perpendicular to the main scanning direction). The two through-holes 4*b* partially overlap with each other as seen in the sheet conveying direction B, and are adjacent to each other in the sheet conveying direction B. Each head frame 4*a* supports the corresponding two inkjet heads 2 such that the nozzle opening surfaces 3*a* of the two inkjet heads 2 are exposed through lower openings of the respective through-holes 4*b*. In the present embodiment, the eight inkjet heads 2, the four head frames 4*a* and the frame 4 cooperate to constitute a head assembly H. Further, in the present embodiment, a lower surface of each head frame 4*a* and the nozzle opening surfaces 3*a* of the corresponding two inkjet heads 2 lie on a single plane, and a gap between the nozzle opening surfaces 3*a* is filled with the head frame 4*a*. This arrangement may be modified such that the nozzle opening surfaces 3*a* of the corresponding two inkjet heads 2 may be located on a lower side of the lower surface of each head frame 4*a* and a gap between the nozzle opening surfaces 3*a* is filled with a filler plate as an additionally prepared member.

Each head frame 4*a* has a first positioning hole 41*a* and a pair of second positioning holes 41*b*, a shown in FIG. 4, such that a first positioning pin 61*a* can be introduced into the first positioning hole 41*a* while a pair of second positioning pins 61*b* can be introduced into the second positioning holes 41*b*, for positioning a cap unit 76 in a predetermined position relative to the head frame 4*a*. The first positioning hole 41*a* is a through-hole having a circular-shaped opening that is located in a center of the head frame 4*a*, i.e., in a center of a line segment interconnecting centers of the respective nozzle opening surfaces 3*a* of the corresponding two inkjet heads 2. As shown in FIG. 5, an O-ring 41*c* is disposed on an inner circumferential surface of the first positioning hole 41*a*, so that the first positioning pin 61*a* is brought into contact in its outer circumferential surface with an inner circumferential surface of the O-ring 41*c* when the first positioning pin 61*a* is introduced into the first positioning hole 41*a*, whereby the first positioning hole 41*a* can be reliably sealed.

As shown in FIG. 4, the two second positioning holes 41*b* are located in respective end portions of the head frame 4*a* that are opposite to each other in the main scanning direction. Each of the second positioning holes 41*b* is positioned in a position which is located substantially in a center of a corresponding one of the end portions in the sheet conveying direction B and which is adjacent to a corresponding one of the nozzle opening surfaces 3*a* on a plane including the nozzle opening surfaces 3*a*. Each of the second positioning holes 41*b* is an elongated hole that is elongated in the main scanning direction, i.e., a direction in which the second positioning hole 41*b* is distant from the first positioning hole 41*a* (i.e., from the center of the head frame 4*a*). That is, each second positioning hole 41*b* has a lower opening that is elongated in the main scanning direction. It is noted that an upper opening of each second positioning hole 41*b* is sealed as shown in FIG. 5. The first and second positioning holes 41*a*, 41*b* lie on a single line which passes through the center of the head frame 4*a* and which extends in the main scanning direction. The positions of the two second positioning holes 41*b* are symmetrical with respect to the center of the head frame 4*a*.

As shown in FIGS. 2 and 3, the inkjet printer 1 includes a pair of head-assembly movement mechanisms 51 configured to support the head assembly H such that the supported head assembly H is vertically movable. The head-assembly movement mechanisms 51 are located on respective sides of the plurality of inkjet heads 2 which sides are opposite to each other in the sheet conveying direction B. Each of the head-assembly movement mechanisms 51 includes a drive motor 52 as a drive source for moving the head assembly H in a vertical direction, a pinion 53 that is fixed to a drive shaft of the drive motor 52, a rack 54 which is fixed to the frame 4 of the head assembly H and which mesh with the pinion 53, and a guide 56 for guiding the rack 54. The rack 54 extends in the vertical direction, and is interposed between the pinion 53 and the guide 56, as shown in FIG. 3.

As shown in FIG. 2, the inkjet printer 1 has a pair of frame members 1*a* that are opposed to each other in the sheet conveying direction B. The drive motors 52 of the respective head-assembly movement mechanisms 51 are fixed to the respective frame members 1*a*. The vertically extending racks 54 of the respective head-assembly movement mechanisms 51 have respective lower end portions that are fixed to side surfaces of the frame 4 of the head assembly H. As shown in FIG. 3, each of the racks 54 is slidably contact, at one of its opposite side surfaces that is remote from the pinion 53, with the guide 56 that is fixed to a corresponding one of the frame members 1*a*.

Owing to provision of the head-assembly movement mechanisms 51 constructed as described above, when the pinions 53 are rotated in a forward or reverse direction by synchronized drives of the drive motors 52, the racks 54 are moved in an upward or downward direction. As a result of the vertical movement of the racks 54, the head assembly H is vertically moved, namely, the frame 4 is vertically moved together with the four head frames 4*a* and the eight inkjet heads 2.

As shown in FIGS. 2 and 3, two guide portions 59 are provided in respective opposite sides of the frame 4 in a longitudinal direction in which each inkjet head 2 is elongated. Each of the guide portions 59 includes a pair of guided members 57 and a bar-shaped member 58 that is interposed between the guided members 57. The inkjet printer 1 has a pair of frame members 1*b* that are opposed to each other in a direction perpendicular to the sheet conveying direction B. The pair of guided members 57 of each guide portion 59 are fixed to a corresponding one of the frame members 1*b*. The bar-shaped member 58 of each guide portion 59 extends vertically as the guided members 57, and are fixed to a side surface of the frame 4 that is parallel to the corresponding frame member 1*b*. The bar-shaped member 58 is slidably interposed between the pair of guided members 57. Owing to provision of the guide portions 59, the fame 4 can be vertically moved without inclination of the nozzle opening surfaces 3*a* of the inkjet heads 2 relative to the conveyor surface 8*a*.

The head assembly H is positioned in a recording operation position (i.e., a position as shown in FIG. 3), except when the inkjet heads 2 are subjected to maintenance operations. That is, a recording operation is performed by causing the eight inkjet heads 2 to eject the ink droplets onto the paper sheet, while the head assembly H is positioned in the recording operation position. Only when the maintenance operations are to be performed onto the inkjet heads 2, the head assembly H is moved upwardly by the head-assembly movement mechanism 51 so as to be positioned in a maintenance operation position that is located above the recording operation position.

There will be described a maintenance unit 70 configured to carry out the maintenance operations to which the inkjet heads 2 are to be subjected. As shown in FIGS. 2 and 3, the maintenance unit 70 is disposed on a left side of the plurality of the inkjet heads 2, and has two trays 71, 75 that are horizontally movable. The tray 71 has a box-like shape with an upper opening, and the tray 75 is disposed inside the tray 71. The trays 71, 75 are removably engaged with each other through an engager that will be described below, such that they can be selectively engaged with and disengaged from each other, depending on a selected one of the maintenance operations.

As shown in FIG. 3, the tray 71 opens in one of its opposite ends that is remote from the plurality of inkjet heads 2, so that only the tray 71 is movable without movement of the tray 75 when the engagement of the trays 71, 75 is released, for example, for carrying out a purging operation as one of the maintenance operations. Further, irrespective of an operating state of the engager, when the maintenance unit 70 is to be moved horizontally (in a direction indicated by arrow D in FIG. 3), the head assembly H is moved upwardly (in a direction indicated by arrow C in FIG. 3) to be positioned in the maintenance operation position, prior to the horizontal movement of the maintenance unit 70, so as to provide a space between the conveyor surface 8*a* and the plurality of nozzle opening surfaces 3*a*. After the upward movement of the head assembly H, the maintenance unit 70 is horizontally moved to be accommodated in the space between the conveyor surface 8*a* and the plurality of nozzle opening surfaces 3*a*.

As shown in FIG. 3, a waste-ink receiver tray 77 is disposed right below the maintenance unit 70, and has a size that permits a periphery of the tray 71 to be surrounded by a periphery of the waste-ink receiver tray 77 as seen in a plan view. The waste-ink receiver tray 77 is positioned in a fixed position such that the waste-ink receiver tray 77 overlaps with at least a left end portion (as seen in FIGS. 2 and 3) of the tray 71 even when the tray 71 is moved to a right end position (as seen in FIGS. 2 and 3). The waste-ink receiver tray 77 has a drain hole 77*a* which is provided in a right end portion (as seen in FIG. 3) of the tray 77 and which is formed through a bottom wall of the tray 77, so that waste ink received by the tray 77 flows into a waste-ink retainer (not shown) via the drain hole 77*a*.

Within the tray 71, there are a wiper 72, an ink capture 73 and the above-described tray 75 that are arranged in this order as viewed in a direction away from the plurality of inkjet heads 2. As shown in FIG. 2, the four cap units 76 are disposed in the tray 75. Each of the cap units 76 is provided for a corresponding one of pairs of the inkjet heads 2, and has two annular protrusions 76*a*, a bottom plate 76*b* and the above-described single first positioning pin 61*a* and two second positioning pins 61*b*. The two annular protrusions 76*a* are provided for two nozzle opening surfaces 3*a* of the corresponding pair of the inkjet heads 2, and are supported from below by the bottom plate 76*b*. The bottom plate 76*b*, which serves as a supporting tray, has a rectangular shape and is elongated in the main scanning direction. The four cap units 76 are arranged in the sheet conveying direction B, as shown in FIG. 2, and each of the four cap units 76 is provided for a corresponding one of the four head frames 4*a*.

The two annular protrusions 76*a* of each cap unit 76 are positioned relative to each other such that the two annular protrusions 76*a* partially overlap with each other as seen in the sheet conveying direction B and such that the two annular protrusions 76*a* are adjacent to each other as seen in the main scanning direction. Thus, the total of eight annular protrusions 76*a* of the four cap units 76 are arranged in two rows (that extend in the sheet conveying direction B) in a zigzag pattern or in a staggered fashion. The annular protrusions 76*a* project upwardly from an upper surface of the bottom plate 76*b*, and cooperate with the bottom plate 76*a* to define recesses 76*c* that open upwardly. Each of the recesses 76*c* has, as seen in a plan view, a shape suitable for surrounding a corresponding one of the nozzle opening surfaces 3*a* or surrounding the nozzles 3*b* opening in the corresponding nozzle opening surface 3*a*. The bottom plate 76*b* has through-holes (not shown) each of which is formed through substantially a center of a surrounded portion of the bottom plate 76*b* that is surrounded by a corresponding one of the annular protrusions 76*a*. Thus, each recess 76*c* can be brought into communication with the tray 71 via a corresponding one of the through-holes and a corresponding discharge path (not shown) that is provided with a valve. During the purging operation (that is described below), the valve is open, so that ink received in the recess 76*c* is discharged into the waste-ink receiver tray 77 via the tray 71. The valve is closed when ink in the nozzles 3*b* is to be prevented from being dried.

Figure 6:
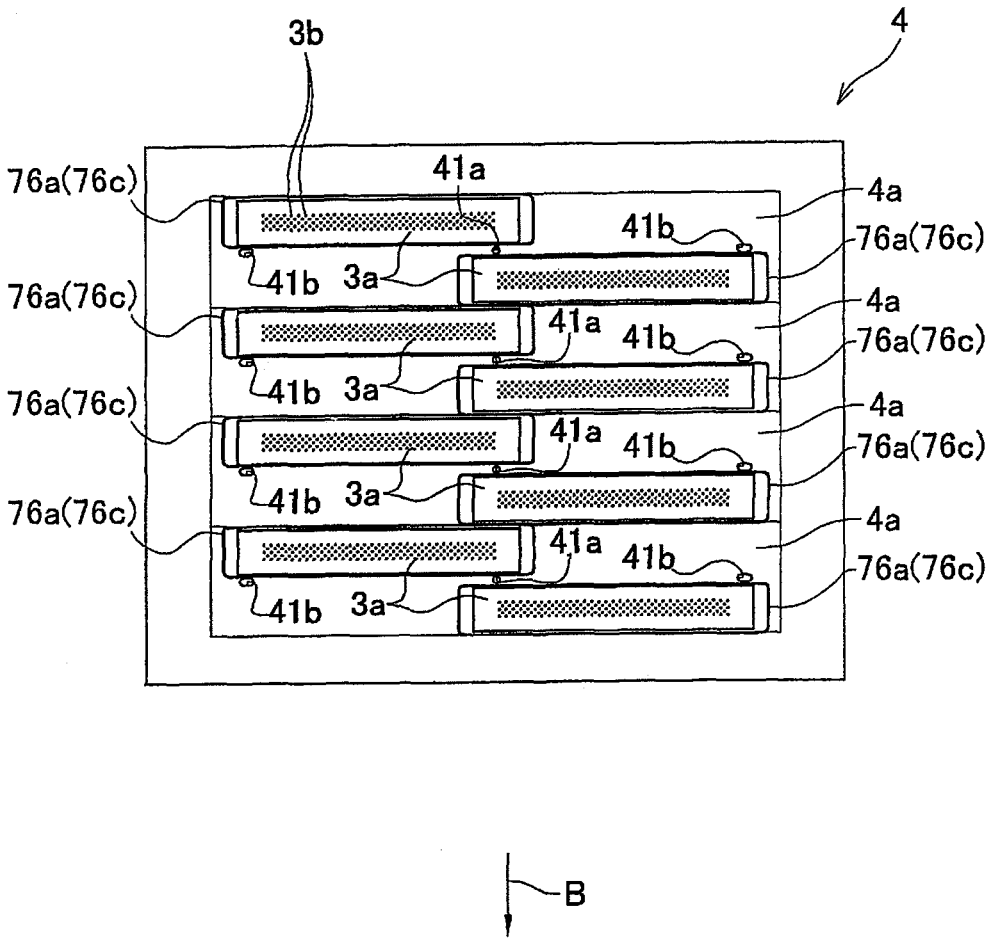
FIG. 6 is a plan view showing a positional relationship between each of the annular protrusions of the cap unit and a corresponding one of the inkjet recording heads when the annular protrusions are in contact with the head frame.

Upon a capping action (that is described below), the two annular protrusions 76*a* of each cap unit 76 are brought into contact with only a corresponding one of the four head frames 4*a*. In this instance, the two recesses 76*c* of each cap unit 76 covers the two nozzle opening surfaces 3*a* of the pair of inkjet heads 2 that are held by the corresponding head frame 4*a*, so that the nozzle opening surfaces 3*a* are closed (as shown in FIG. 6). Thus, according to this arrangement in which the two nozzle opening surfaces 3*a* can be covered by the respective two recesses 76*c*, the ink purged from the nozzles 3*b* of the nozzle opening surface 3*a* can be received while the ink in the nozzles 3*b* can be prevented from being dried. It is noted that each annular protrusion 76*a* is made of an elastic material such as rubber, which facilitates the head frames 4 to be brought into close contact with the annular protrusions 76*a*, thereby making it possible to establish air tightness within each recess 76*c* upon contact of the frames 4*a* with the annular protrusions 76*a*.

The first positioning pin 61*a* and the two second positioning pins 61*b* are provided by cylindrical pins that extend upwardly from the bottom plate 76*b* of each cap unit 76 in a direction perpendicular to a plane containing contact portions of the respective annular protrusions 76*a* that are to be in contact with the corresponding head frame 4*a*. For facilitating engagement of the pins 61*a*, 61*b* with the respective positioning holes 41*a*, 41*b*, each of the pins 61*a*, 61*b* has a distal end portion that is tapered, so as to have a small diameter in its distal end, as shown in FIG. 3. In each cap unit 76, the first positioning pin 61*a* projects upwardly from a first-pin-located portion of the bottom plate 76*b* while the second positioning pins 61*b* project upwardly from respective two second-pin-located portions of the bottom plate 76*b*. The first-pin-located portion is outside the annular protrusions 76*a*, and is located in substantially a center of the bottom plate 76*b*. The two second-pin-located portions are outside the annular protrusions 76*a*, and are located in respective end portions of the bottom plate 76*b* that are opposite to each other in the main scanning direction (i.e., in a supporting-tray longitudinal direction) in which the bottom plate 76*b* is elongated. Each of the two second-pin-located portions is provided by a central portion, as viewed in the sheet conveying direction B, of a corresponding one of the opposite end portions of the bottom plate 76*b*. Thus, the first and second positioning pins 61*a*, 61*b* are positioned in the respective positions lying on a straight line which passes through the center of the bottom plate 76*b* and which extends in the main scanning direction. Further, the two second-pin-located portions are symmetrical with respect to the first-pin-located portion, so that a pressing force can be evenly applied to two contact portions of the head frame 4*a* from the two annular protrusions 76*a*, upon contact of the two annular protrusions 76*a* with the two contact portions of the head frame 4*a*. This arrangement contributes to reliable formation of the enclosed space upon the capping action even where the annular protrusions 76*a* is pressed against the head frame 4*a* with a reduced pressing force.

As shown in FIG. 3, the distal end of each of the first and second positioning pins 61*a*, 61*b* is located on an upper side of a distal end of each of the annular protrusions 76*a*. In other words, the distal end of each of the positioning pins 61*a*, 61*b* is more distant from the bottom plate 76*b*, than the distal end of each of the annular protrusions 76*a*. As described below, upon the capping action, the first positioning pin 61*a* is introduced into the first positioning hole 41*a* while the second positioning pins 61*b* are introduced into the second positioning holes 41*a*, whereby the cap unit 76 is reliably positioned in a predetermined position relative to the head frame 4*a*. After initiation of the introduction of the pins 61*a*, 61*b* into the holes 41*a*, 41*b*, the annular protrusions 76*a* are brought into contact with the head frame 4*a*. In this instance, since the cap unit 76 has been already positioned in the predetermined position, the annular protrusions 76*a* can be accurately brought into contact with predetermined portions of the head frame 4*a*.

It is noted that the cap unit 76 is formed by a double injection molding such that the annular protrusions 76*a* are made of an elastic material while the bottom plate 76 and the positioning pins 61*a*, 61*b* are made of a resin material that is harder than the elastic material.

The cap units 76 are supported by a bottom wall of the tray 75. Described more specifically, as shown in FIGS. 3 and 5B, the cap units 76 are upwardly biased by coil springs 75*a* that are disposed on the bottom wall of the tray 75. The coil springs 75*a* serve to alleviate shock upon contact of the annular protrusions 76*a* of the cap units 76 with the head frames 4*a*. Further, owing to the coil springs 75*a*, even if each cap unit 76 were not precisely parallel to the corresponding head frame 4*a*, the upper end of each annular protrusion 76*a* can be entirely brought into contact with the corresponding head frame 4*a*, without suffering from influence of the inclination of each cap unit 76 with respect to the head frame 4*a*. Thus, the enclosed space can be provided by each recess 76*c*.

As shown in FIGS. 2 and 3, in one of opposite end portions of the tray 71 that is close to the plurality of inkjet heads 2, there is fixedly disposed a holder member 74 that holds the wiper 72 and the ink capture 73. As shown in FIG. 2, the holder member 74 has a U-shape as seen in its plan view, so as to include opposite end portions which extend in a direction perpendicular to the sheet conveying direction B and an interconnecting portion which interconnects the opposite end portions and which extends in the sheet conveying direction B. The wiper 72 and the ink capture 73 are held in the interconnecting portion of the holder member 74. The above-described engager (through which the trays 71, 75 are removably engaged with each other) includes a pair of engager recesses 74*a* that are provided in distal end portions of the respective opposite end portions of the holder member 74.

As shown in FIGS. 2 and 3, the ink capture 73 has a plurality of thin plates 73*a* each extending in the sheet conveying direction B and having a length that is slightly larger than a length of a row of the eight inkjet heads 2. The thin plates 73*a*, each of which is made of stainless steel, are parallel to one another and spaced apart from one another by a distance suitable for causing capillary action of the ink.

Like the thin plates 73*a*, the wiper 72 extends in the sheet conveying direction B and has a length that is slightly larger than the length of the row of the eight inkjet heads 2. As shown in FIGS. 2 and 3, the wiper 72 is fixed to a bottom surface of a groove 72*a* which is provided in the interconnecting portion of the U-shaped holder member 74 and which extends in the sheet conveying direction B. The ink wiped by the wiper 72 is dropped into the waste-ink receiver tray 77 via the groove 72*a* and the tray 71. It is noted that the wiper 72 is made of an elastic material such as rubber.

As described above, the trays 71, 75 are removably engaged with each other through the engager. As shown in FIG. 2, the engager is constituted by the above-described pair of engager recesses 74*a* (that are provided in the distal end portions of the respective opposite end portions of the holder member 74) and a pair of hook members 83 that are pivotably held by the tray 75. Each of the hook members 83 extends in the direction perpendicular to the sheet conveying direction B, and is pivotably held at its central portion by the tray 75. Each hook member 83 has an engaging portion 83*a* which is provided by one of its opposite end portions that is close to the plurality of inkjet heads 2 and which is to be brought into engagement with a corresponding one of the engager recesses 74*a*. A pair of contact members 84 are disposed on an upper side of the maintenance unit 70. Each of the contact members 84 is pivotable so as to be brought into contact with a contact portion 83*b* of a corresponding one of the hook members 83, which is provided by the other of the opposite end portions that is remote from the plurality of inkjet heads 2. When the contact members 84 are pivoted to be brought into contact with the contact portions 83*b* of the respective hook members 83, the engaging portions 83*a* of the respective hook members 83 are disengaged from the respective engager recesses 74*a*. On the other hand, when the contact members 84 are pivoted to be separated from the contact portions 83*b*, the engaging portions 83*a* are brought into engagement with the respective engager recesses 74*a*. FIG. 3 shows this state in which the engaging portions 83*a* are engaged with the respective engager recesses 74*a*.

When the maintenance operations are not to be carried out by the maintenance unit 70, the unit 70 is held stationary in a non-working position that is distant from the plurality of inkjet heads 2. FIGS. 2 and 3 show a state in which the maintenance unit 70 is positioned in the non-working position so as not to be opposed to the inkjet heads 2. When the maintenance operations are to be carried out, the maintenance unit is horizontally moved away from the non-working position to a working position so as to be opposed to the plurality of inkjet heads 2. In this instance, the frame 4 (that holds the plurality of inkjet heads 2) is positioned in the maintenance operation position, distal ends of the wiper 72 and the annular protrusions 76*a* are not brought into contact with the nozzle opening surfaces 3*a*. Further, when the wiper 72 are in contact with the nozzle opening surfaces 3*a*, a small clearance (e.g., 0.5 mm) is constantly defined between the ink capture 73 and the nozzle opening surfaces 3*a*.

When the nozzle opening surfaces 3*a* of the respective inkjet heads 2 are to be sealed by the recesses 76*c* of the respective cap units 76, the trays 71, 75 are jointed to each other through the above-described engager so as to be moved together with each other to the working position. As shown in FIG. 2, the trays 71, 75 are movably supported by a pair of guide rods 96*a*, 96*b* that extend in the direction perpendicular to the sheet conveying direction B, through respective pairs of guided members 97, 98 that are guided by the guide rods 96*a*, 96*b*. The pair of guided members 97*a*, 97*b* protrude from the respective opposite end portions of the holder member 74 that is fixed to the tray 71. The pair of guided members 98*a*, 98*b* protrude from respective opposite end portions of the tray 75. Each of the guide rods 96*a*, 96*b*, which are parallel to each other, is fixed at its opposite end portions to the respective frame members 1*b*, 1*d* by suitable fixtures such as screws. Thus, the trays 71, 75 are movable along the guide rods 96*a*, 96*b* in parallel to a direction indicated by arrow D in FIG. 3.

There will be described a horizontal movement mechanism 91 that is configured to horizontally move the trays 71, 75. As shown in FIG. 2, the horizontal movement mechanism 91 includes, in addition to the guide rods 96*a*, 96*b*, a motor 92, a drive pulley 93, an idler pulley 94 and a timing belt 95. The motor 92 is fixed, by suitable fixtures such as screws, to a fixed portion 1*c* provided in an end portion of the frame member 1*b* that extends in the sheet conveying direction B. The drive pulley 93 is fixed to a drive shaft of the motor 92, so as to be rotated when the motor 92 is driven. The idler pulley 94 is rotatably supported by the frame member 1*d* (i.e., left-side frame member as seen in FIG. 2). The timing belt 95 is stretched around a pair of pulleys in the form of the drive pulley 93 and the idler pulley 94, so as to be held in parallel to the guide rod 96*a*. The guided member 97*a*, which is one of the pair of guided members 97*a*, 97*b*, is connected to the timing belt 95.

Owing to the horizontal movement mechanism 91 that is constructed as described above, when the motor 92 is driven, the timing belt 95 is circulated as a result of rotation of the drive pulley 93 in forward or reverse direction. As the timing belt 95 is thus circulated, the tray 71 (that is connected to the timing belt 95 through the guided member 97*a*) is moved in rightward or leftward direction as seen in FIGS. 2 and 3, i.e., in a direction toward the non-working position or working position. When the engaging portions 83*a* of the respective hook members 83 are engaged with the engager recesses 74*a* of the holder member 74, the wiper 92 and the ink capture 73 (that are fixed relative to the tray 71) are moved together with the cap unit 76 (that is fixed to the tray 75) toward the working position or non-working position. On the other hand, when the engaging portions 83*a* are disengaged from the engager recesses 74*a*, the wiper 92 and the ink capture 73 (that are fixed relative to the tray 71) are moved toward the working position or non-working position.

Referring next to FIGS. 5-7, there will be described the maintenance operations performed by the maintenance unit 70. The purging operation as one of the maintenance operations is carried out when the inkjet heads 2 suffer from unsatisfactory ejection performance due to foreign matters sticking to the nozzles 3*b* and excessively increased viscosity of ink adjacent to the nozzles 3*b*. In the purging operation, a predetermined amount of ink is forcedly discharged from each nozzle 3*b*, so as to improve or restore the ejection performance of each inkjet head 2. The maintenance operations further include a flushing operation in which a predetermined number of ink droplets are ejected (flushed) from each nozzle 3*b*, so as to prevent the inkjet heads 2 from suffering from unsatisfactory ejection performance. In the present embodiment, the ink discharged in the purging operation is received by the cap units 76.

Figure 5A:
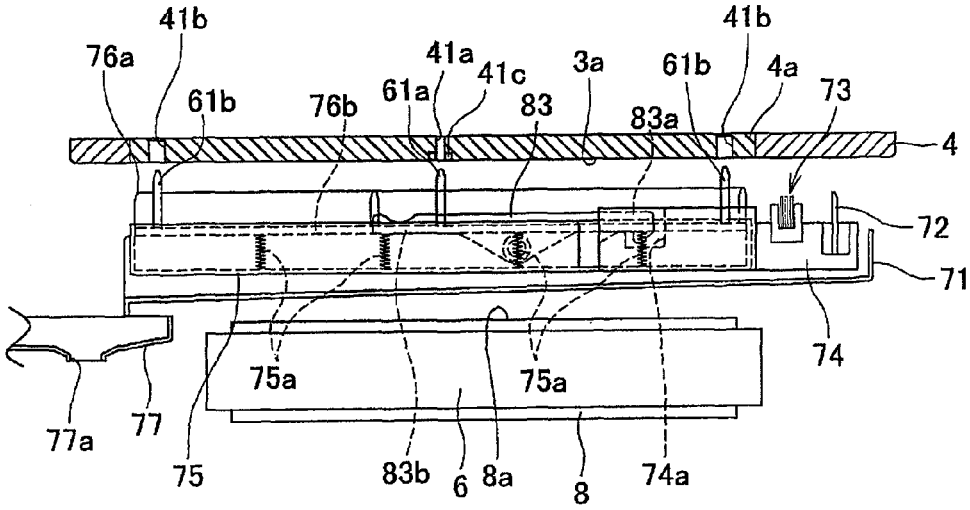
FIG. 5A is a view showing a stage in which an entirety of a maintenance unit has been moved to a working position in the inkjet printer.
Figure 5B:
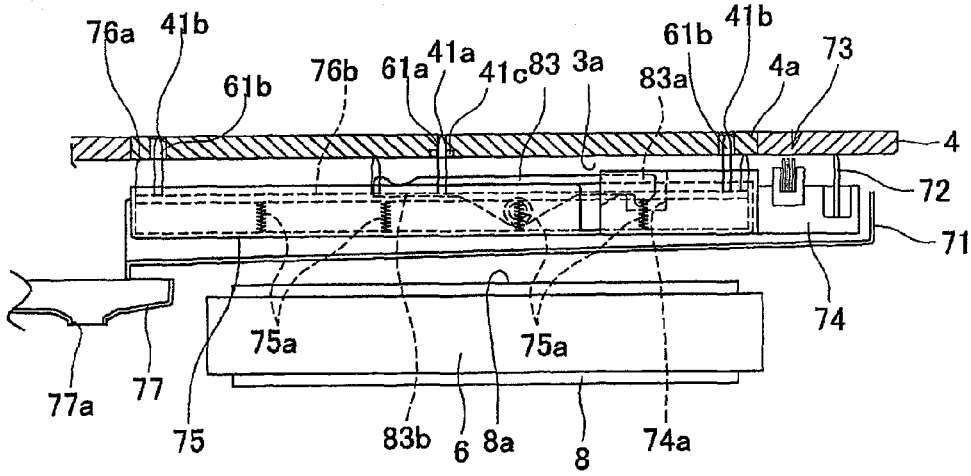
FIG. 5B is a view showing a stage in which annular protrusions of a cap unit is in contact with a head frame in the inkjet printer.
Figure 7A:
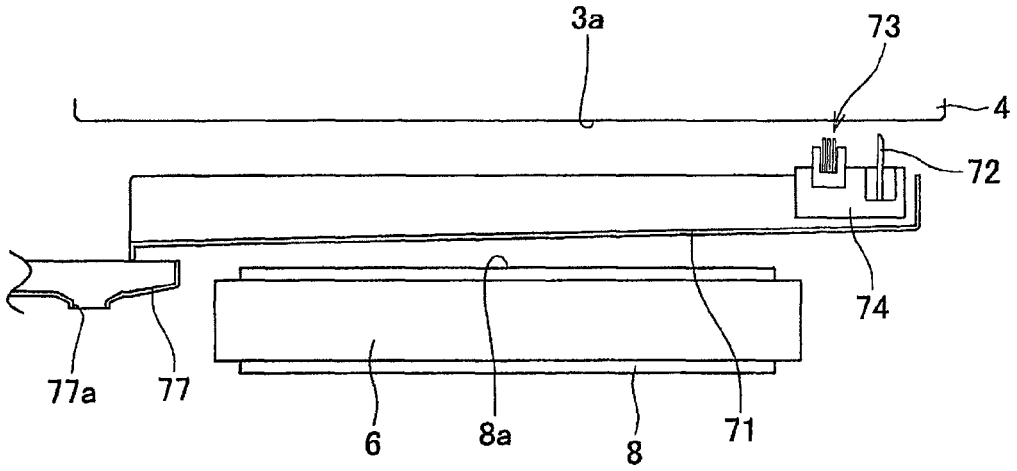
FIG. 7A is a view showing a state in which a head assembly (including the recording heads and the head frame) has been upwardly moved from a recording operation position to a maintenance operation position while the maintenance unit has been horizontally moved to the working position.
Figure 7B:
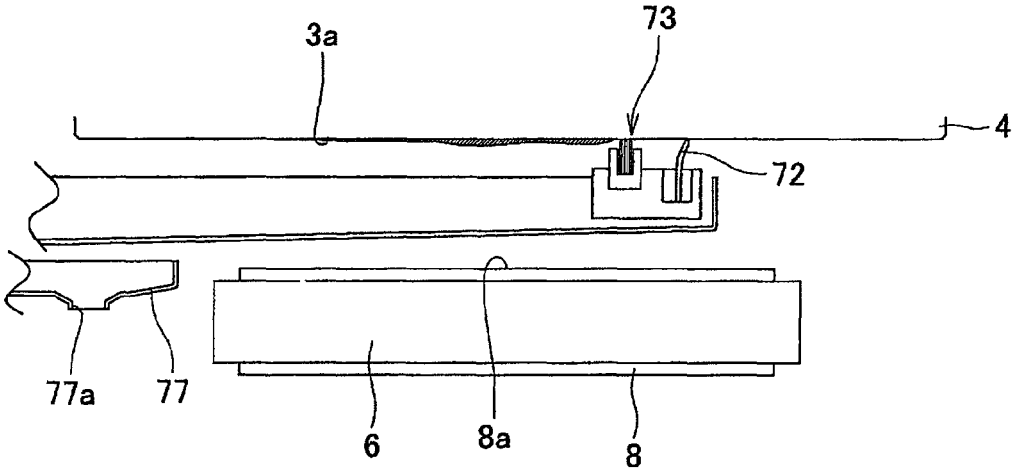
FIG. 7B is a view showing a state in which ink sticking to nozzle opening surfaces of the recording heads is being wiped by an ink capture and a wiper of the maintenance unit.

FIG. 5A shows a state in which the maintenance unit 70 in its entirety has been moved to be positioned in the working position. FIG. 5B shows a contact state in which the annular protrusions 76*a* of the cap units 76 are in contact with the head frames 4*a*. FIG. 6 is a plan view showing a positional relationship between each head frame 4*a* and the corresponding annular protrusions 76*a* in the contact state. FIG. 7A shows a state in which the head assembly H has been moved upwardly from the recording operation position to the maintenance operation position while the tray 71 of the maintenance unit 70 has been horizontally moved to the working position. FIG. 7B shows a state in which the ink sticking to the nozzle opening surfaces 3*a* of the respective inkjet heads 2 is being wiped by the ink capture 73 and the wiper 72.

When the purging operation is to be carried out for restoring the ejection performance of each inkjet head 2, the head assembly H is upwardly moved by the head-assembly movement mechanism 51. In this instance, the two drive motors 52 are driven in synchronization with each other, so as to rotate the two pinions 53 in forward direction (i.e., clockwise direction as seen in FIG. 3), whereby the two racks 54 are moved upwardly as a result of the rotations of the two pinions 53 so that the frame 4 (to which the racks 54 are fixed) are moved upwardly together with the eight inkjet heads 2. Then, when the head assembly H reaches the maintenance operation position, the two drive motors 52 are stopped. Thus, between the conveyor belt 8 and the nozzle opening surfaces 3*a*, there is provided the space available for disposition of the maintenance unit 70. In this instance in which the head assembly H positioned in the maintenance operation position, the plane containing the nozzle opening surfaces 3*a* of the inkjet heads 2 is vertically spaced apart from the distal ends of the wiper 72 and the annular protrusions 76*a* of the maintenance unit 70. Therefore, the wiper 72 and the annular protrusions 76*a* are not brought into contact with the nozzle opening surfaces 3*a* even after the maintenance unit 70 has been moved to the working position.

Then, the capping action is performed to cause the recesses 76*a* of the cap units 76 to seal the nozzle opening surfaces 3*a*. When the capping action is to be carried out, the trays 71, 75 are moved to the working position by the horizontal movement mechanism 91 while the trays 71, 75 are jointed to each other by the hook members 83, as shown in FIG. 5A. In this instance, the four cap units 76 are positioned in respective positions opposed to the respective four head frames 4*a*, as shown in FIG. 6. Described more in detail, the two recesses 76*c* of each cap unit 76 are opposed to the nozzle opening surfaces 3*a* of the respective two inkjet heads 2 that are supported by the corresponding head frame 4*a*, and the first and second positioning pins 61*a*, 61*b* of each cap unit 76 are opposed to the first and second positioning holes 41*a*, 41*b* of the corresponding head frame 4*a*.

Next, by causing the head-assembly movement mechanism 51 to move the head assembly H downwardly, the distal end portions of the first and second positioning pins 61*a*, 61*b* are introduced into the first and second positioning holes 41*a*, 41*b*, as shown in FIG. 5B. In this instance, even if each cap unit 76 were somewhat misaligned with respect to the corresponding head frame 4*a*, the first and second positioning pins 61*a*, 61*b* could, be introduced into the first and second positioning holes 41*a*, 41*b* since each of the pins 61*a*, 61*b* has the tapered distal end portion. The misalignment of each cap unit 76 with respect to the corresponding head frame 4*a* could be corrected, since the first and second positioning pins 61*a*, 61*b* are guided by the first and second positioning holes 41*a*, 41*b* upon introductions of the pins 61*a*, 61*b* into the holes 41*a*, 41*b*. Further, in this instance, even if each cap unit 76 were deformed, for example, due to change of ambient temperature, the second positioning pins 61*b* could be reliably introduced into the respective second positioning holes 41*b* as long as the first positioning pin 61*a* is positioned in a position corresponding to the first positioning hole 41*a*, since each of the second positioning holes 41*b* is elongated in a direction in which the second positioning holes 41*b* are distant from the first positioning hole 41*a* (i.e., center of the head frame 4*a*). Each cap unit 76 is restricted, by the introductions of the second positioning pins 61*b* into the respective second positioning holes 41*b*, from being rotated about the first positioning pin 61*a*, whereby each cap unit 76 can be positioned relative to the corresponding head frame 4*a* with high accuracy.

Then, by causing the head-assembly movement mechanism 51 to further move the head assembly H downwardly, the annular protrusions 76*a* are brought into contact with the head frames 4*a* so as to surround the nozzle opening surfaces 3*a* or the nozzles 3*b* opening in the nozzle opening surfaces 3*a* whereby each cap unit 76 is attached to the corresponding head frame 4*a*. In this instance, the nozzle opening surfaces 3*a* of the two inkjet heads 2 supported by each head frame 4*a* are covered by the respective recesses 76*c* of the corresponding cap unit 76. The capping action is completed when the nozzle opening surfaces 3*a* are sealed.

After the capping action has been completed, a pump (not shown) is activated to forcedly supply ink from an ink tank (not shown) to each inkjet head 2, so as to carry out the purging operation for ejecting the ink from each inkjet head 2 through the nozzles 3*b* toward the corresponding recess 76*c* (that is opposed to the inkjet head 2). By the purging operation, it is possible to restore the ejection performance of each inkjet head 2 suffering from unsatisfactory ejection performance due to, for example, clogging of nozzles 3*b* and excessively increased viscosity of ink adjacent to the nozzles 3*b*. The ink ejected into each recess 76*c* flows into the tray 71 via the discharge path (not shown), and then flows along a bottom surface of the tray 71 in leftward direction as seen in FIG. 5B so as to be received by the waste-ink receiver tray 77. Thus, the purged ink is eventually discharged through the drain hole 77*a*. However, a part of the purged ink remains on the nozzle opening surface 3*a*, taking the form of ink droplets.

The purging operation is followed by a wiping operation. The wiping operation may be carried out either with both of the trays 71, 75 being positioned in the working position or with only the tray 71 being positioned in the working position. In the latter case, the trays 71, 75 are disengaged from each other when having been returned to the non-working position after the purging operation, and then only the tray 71 is moved to be newly positioned in the working position. The disengagement of the trays 71, 75 from each other is made by releasing engagement of the engager recesses 74*a* with the engaging portions 83*a* of the respective hook members 83. The engagement of the engager recesses 74*a* with the engaging portions 83*a* can be released by causing the contact members 84 to be brought into contact with the end portions 83*b* of the respective hook members 83. It is noted that, when the tray 71 or trays 71, 75 are moved between the working position and the non-working position, the head assembly H is positioned in the maintenance operation position so as not to interfere the horizontal movement.

In the wiping operation, the head assembly H is downwardly moved by the head-assembly movement mechanism 51 while at least the tray 71 is being positioned in the working position. The head assembly H is downwardly moved to be positioned in a height position which permits the distal end of the wiper 72 to be brought into contact with the nozzle opening surfaces 3*a* of the inkjet heads 2 when the tray 71 is being moved toward the non-working position (in leftward direction as seen in FIGS. 7A and 7B), and which provides a gap of 0.5 mm between the ink capture 73 and the nozzle opening surface 3*a*. After the head assembly H has been moved to the height position, the tray 71 is moved toward the non-working position by the horizontal movement mechanism 91.

When the tray 71 is being horizontally moved toward the non-working position with the head assembly H is being positioned in the above-described height position, the upper ends of the thin plates 73*a* of the ink capture 73 are vertically distant from the nozzle opening surfaces 3*a* of the inkjet heads 2 by a small distance, without being brought into contact with the nozzle opening surfaces 3*a*. Owing to this arrangement, relatively large ink droplets as a part of the ink sticking to the nozzle opening surfaces 3*a* are captured by the ink capture 73. That is, the relatively large ink droplets are moved together with the ink capture 73, owing to capillary action of the ink that is caused between the thin plates 73*a* of the ink capture 73. Further, in this instance, the other part of the ink sticking to the nozzle opening surfaces 3*a* is wiped by the wiper 72 which is disposed on a rear side of the ink capture 73 and which is deflected due to its contact with the nozzle opening surfaces 3*a*.

The ejection performance of the inkjet heads 2 is restored by the purging operation, and then the ink having stuck to the nozzle opening surfaces 3*a* by the purging operation is wiped by the wiping operation, as described above. After the maintenance operations have been completed, it is preferable to newly carry out the capping action for sealing the nozzle opening surfaces 3*a* with the cap units 76, so as to prevent the ink within the nozzles 3*b* from being dried.

In the inkjet printer 1 constructed as described above, since the first positioning pin 61*a* enables each cap unit 76 to be accurately positioned relative to the corresponding head frame 4*a*, it is possible to cause the two annular protrusions 76*a* of each cap unit 76 to accurately surround the two nozzle opening surfaces 3*a* of the respective inkjet heads 2 that are supported by the corresponding head frame 4*a*. Owing to this feature, the nozzle opening surfaces 3*a* can be reliably sealed by the annular protrusions 76*a* that are accurately positioned relative to the nozzle opening surfaces 3*a*, with the simplified structure for sealing the nozzle opening surfaces 3*a*, namely, without employing an expensive system including a control device and a movement mechanism.

Further, in the present embodiment, since the first-pin-located portion (from which the first positioning pin 61*a* projects upwardly) is located in substantially the center of the bottom plate 76*b*, each nozzle opening surface 3*a* can be reliably sealed even where the shape of the corresponding cap unit 76 is changed, for example, due to change of ambient temperature. This is because, where each cap unit 76 is deformed, each cap unit 76 is displaced relative to the corresponding nozzle opening surface 3*a*, evenly around the center of the bottom plate 76*b*, namely, an amount of displacement of each cap unit 76 relative to the corresponding nozzle opening surface 3*a* is substantially constant as viewed in a circumferential direction around the center of the bottom plate 76*b*.

Further, in the present embodiment, the second positioning pins 61*b* are provided in addition to the first positioning pin 61*a*, so that rotation of each cap unit 76 about the first positioning pin 61*a* can be restricted by the second positioning pins 61*b*. Further, since the two second-pin-located portions (from which the respective two second positioning pins 61*b* project upwardly) are symmetrical with respect to the first-pin-located portion (from which the first positioning pin 61*a* projects upwardly), an amount of possible misalignment of one of the second positioning pins 61*b* is substantially equal to that of the other of the second positioning pins 61*b* where the shape of each cap unit 76 is changed due to change of ambient temperature. That is, even where each cap unit 76 is deformed, it is possible to minimize an amount of misalignment of each annular protrusion 76*a*.

Further, in the present embodiment, since each of the second positioning holes 41*b* (into which the respective second positioning pins 61*b* are to be introduced) is elongated in the direction in which the second positioning holes 41*b* are distant from the first positioning hole 41*a*, the second positioning pins 61*b* can be reliably introduced into the respective second positioning holes 41*b* even where the second-pin-located portions are displaced, for example, due to change of ambient temperature.

Further, a size of each second positioning hole 41*b* (as measured in the direction in which the hole 41*b* is elongated) may be determined based on an estimated amount of displacement of the corresponding second positioning pin 61*b* relative to the first positioning pin 61*a*. In the present embodiment in which the two second-pin-located portions are symmetrical with respect to the first-pin-located portion, the size of each second positioning hole 41*b* can be made smaller than an arrangement in which the two second-pin-located portions are not symmetrical with respect to the first-pin-located portion. Further, the symmetrical arrangement is effective to simplify process of formation of the holes 41*b*.

Further, in the present embodiment, since the second-pin-located portions are located in respective end portions that are opposite to each other in the direction in which the bottom plate 76*b* is elongated, it is possible to maximize a distance between the first-pin-located portion and each second-pin-located portion, thereby enabling each annular protrusion 76*a* to be more accurately positioned.

Further, in the present embodiment, since the distal ends of the first and second positioning pins 61*a*, 61*b* are more distant, than the distal ends of the annular protrusions 76*a*, from the bottom plate 76*b*, the annular protrusions 76*a* are brought into contact with the head frames 4*a* after the annular protrusions 76*a* have been positioned in predetermined positions during the capping action. Therefore, the annular protrusions 76*a* can be prevented from being displaced from the predetermined positions after being brought into contact with the head frames 4*a*.

Further, in the present embodiment, since each of the second positioning holes 41*b* is adjacent to the nozzle opening surface 3*a* of the corresponding inkjet head 2 in a plane containing the nozzle opening surface 3*a*, each of the annular protrusions 76*a* can be more accurately positioned relative to the corresponding nozzle opening surface 3*a* whereby the nozzle opening surface 3*a* can be more reliably sealed.

Further, in the present embodiment, since the hardness of each of the first and second positioning pins 61*a*, 61*b* is higher than that of each of the annular protrusions 76*a*, each of the annular protrusions 76*a* can be brought into contact with the corresponding head frame 4*a* by a sufficient degree of pressing force while being accurately positioned relative to the corresponding nozzle opening surface 3*a*, so that the nozzle opening surface 3*a* can be more reliably sealed.

Further, in the present embodiment, since the cap unit 76 is formed by the double injection molding, the cap unit 76 can be manufactured in a simplified process, although the annular protrusions 76*a* are made of an elastic material while the bottom plate 76 and the positioning pins 61*a*, 61*b* are made of a resin material.

Further, in the present embodiment, when the first positioning pin 61*a* is introduced into the first positioning hole 41*a* in the capping action, the first positioning pin 61*a* is brought into contact in its outer circumferential surface with the inner circumferential surface of the 0-ring 41*c*, whereby the first positioning hole 41*a* can be reliably sealed. It is therefore possible to prevent entrance of ink into the main body 3 of each inkjet head 2 via the first positioning hole 41*a*.

While the presently preferred embodiment of the present invention has been described above in detail, it is to be understood that the invention is not limited to the details of the illustrated embodiment, but may be otherwise embodied. For example, in the above-described embodiment, the two second-pin-located portions (from which the respective two second positioning pins 61*b* project upwardly) are symmetrical with respect to the first-pin-located portion (from which the first positioning pin 61*a* projects upwardly). However, the second-pin-located portions may be located in respective positions that are not symmetrical with respect to the first-pin-located portion. Further, the second positioning pins 61*b* are not essential and may be eliminated.

Further, in the above-described embodiment, each of the cap units has 76 has the single first positioning pin 61*a* and the two second positioning pins 61*b*. However, the number of the second positioning pins 61*b* of each cap unit 76 may be three or more.

Further, in the above-described embodiment, each of the first and second positioning pins 61*a*, 61*b* has a circular cross sectional shape. However, each of the positioning pins 61*a*, 61*b* may have other cross sectional shape such as triangle and quadrangle. It is preferable that each of the first and second positioning holes 41*a*, 41*b* formed in each head frame 4*a* has a cross sectional shape identical with or conforming to the cross sectional shape of a corresponding one of the positioning pins 61*a*, 61*b*.

Further, in the above-described embodiment, each of the second positioning holes 41*b* (into which a corresponding one of the second positioning pins 61*b*) is an elongated hole that is elongated in the direction in which each second positioning hole 41*b* is distant from the first positioning hole 41*a*. However, each second positioning hole 41*b* may have an complete round-shaped opening.

Further, in the above-described embodiment, each of the cap units 76 has the two annular protrusions 76*a*. However, the number of the annular protrusions 76*a* of each cap unit 76 may be three or more.

Further, in the above-described embodiment, the distal ends of the first and second positioning pins 61*a*, 61*b* are more distant, than the distal ends of the annular protrusions 76*a*, from the bottom plate 76*b*. However, the distal ends of the first and second positioning pins 61*a*, 61*b* may be closer, than the distal ends of the annular protrusions 76*a*, to the bottom plate 76*b*, or may be as distant as the distal ends of the annular protrusions 76*a*, from the bottom plate 76*b*.

Further, in the above-described embodiment, the hardness of each of the first and second positioning pins 61*a*, 61*b* is higher than that of each of the annular protrusions 76*a*. However, the hardness of each of the positioning pins 61*a*, 61*b* may be lower than that of each of the annular protrusions 76*a*, or may be substantially equal to that of each of the annular protrusions 76*a*.

Further, in the above-described embodiment, the O-ring 41*c* is disposed in the first positioning hole 41*a* so as to seal the same hole 41*a*. However, such an annular seal member may be mounted on the first positioning pin 61*a* that is to be introduced into the first positioning hole 41*a*, or may be omitted.

Further, in the above-described embodiment, each two inkjet heads 2 are provided for a corresponding one of the different inks. However, each three or more inkjet heads 2 may be provided for a corresponding one of the different inks. In this modified arrangement, it is preferable that each cap unit 76 has three or more annular protrusions 76*a* arranged to surround the nozzle opening surfaces 3*a* of the respective three or more inkjet heads 2. In this modified arrangement, too, at least one positioning pin is located in the center of the bottom plate 76*b* of each cap unit 76 in the supporting-tray longitudinal direction, i.e., in the longitudinal direction of the bottom plate 76*b*.

Further, in the above-described embodiment, the ink discharged through the nozzles 3*b* during the purging operation is received by the cap units 76 disposed in the tray 75. However, the ink discharged through the nozzles 3*b* may be received by the tray 71. In this modified arrangement, for example, in the purging operation, the tray 71 is moved to the working position so as to receive the discharged ink while the tray 75 remains in the non-working position. The ink received by the tray 71 flows into the waste-ink receiver tray 77. The purging operation is followed by the wiping operation in which the ink sticking to the nozzle opening surfaces 3*a* is removed by the ink capture 73 and the wiper 72 while the tray 71 is being moved back to the non-working position. In this modified arrangement, after the purging operation, a step of separating the tray 75 from the tray 71 is not required. After the wiping operation, the above-described capping action may be carried out, as needed, for preventing increase of viscosity of ink. Thus, in this modified arrangement, the cap units 76 are used mainly for preventing increase of the ink viscosity, so that the cap units 76 are not contaminated with the waste ink, and the nozzle opening surface 3*a* can be sealed by the cap units 76 that are always clean, thereby minimizing possibility of contamination of the nozzles 3*b*.

Further, in the above-described embodiment, the head assembly H is moved by the head-assembly movement mechanism 51, for carrying out the capping action. However, the tray 75 in place of the head assembly H may be moved for carrying out the capping action.

Further, in the above-described embodiment, the nozzle opening surfaces 3*a* are sealed by bringing the annular protrusions 76*a* of the cap units 76 into contact with the head frames 4*a*. However, the nozzle opening surfaces 3*a* may be sealed by the bringing each of the annular protrusions 76*a* of the cap units 76 into contact with a peripheral portion of the corresponding nozzle opening surface 3*a*, which portion surrounds the above-described non-peripheral portion providing the nozzle opening region.

What is claimed is:

1. An image recording apparatus for recording an image on a recording medium by ejecting droplets onto the recording medium, said apparatus comprising:

(a) a head assembly including (a-1) a plurality of recording heads having respective nozzle opening surfaces in each of which a plurality of nozzles open such that the droplets can be ejected through said nozzles toward the recording medium, and (a-2) a head frame supporting said recording heads;

(b) a plurality of annular protrusions each of which is to be brought into contact with said head assembly, so as to surround said plurality of nozzles opening in a corresponding one of said nozzle opening surfaces exposed in said head frame, upon contact of each of said annular protrusions with said head assembly;

(c) a supporting tray supporting said annular protrusions, and elongated in a supporting-tray longitudinal direction in which each of said nozzle opening surfaces of said recording heads is also elongated, such that a dimension of said supporting tray as measured in the supporting-tray longitudinal direction is larger than a dimension of said supporting tray as measured in a supporting-tray width direction which is perpendicular to the supporting-tray longitudinal direction and which is parallel to an opening surface plane that contains said nozzle opening surfaces, (d) a movement mechanism configured to move at least one of said head assembly and said supporting tray, so as to selectively establish a contact state in which said annular protrusions are in contact with said head assembly and a non-contact state in which said annular protrusions are not in contact with said head assembly; and (e) a first pin projecting from a first pin-located portion of said supporting tray, in a direction perpendicular to the opening surface plane, wherein said first pin-located portion of said supporting tray is outside said annular protrusions that are disposed on said supporting tray, and is located in a center of said supporting tray in the supporting-tray longitudinal direction, wherein said head frame has a first hole, into which said first pin is to be introduced upon contact of each of said annular protrusions with said head assembly, wherein said image recording apparatus further comprising at least one second pin projecting from a second-pin-located portion of said supporting tray in the direction perpendicular to said opening surface plane, wherein said second-pin-located portion is outside said annular protrusions that are disposed on said supporting tray, and is distant from said first pin-located portion, wherein said head frame further comprises at least one second hole, into which said at least one second pin is to be introduced upon contact of each of said annular protrusions with said head assembly, wherein said at least one second hole, into which said at least one second pin is to be introduced, has an elongated-shaped opening that is elongated in an elongated direction, which is parallel to a line passing through said first pin and said at least one second pin when said contact state is being established, wherein each of said first and second pins has a circular cross-sectional shape, wherein said first hole, into which said first pin is to be introduced, has a circular-shaped opening that is different in shape from said elongated-shaped opening of said at least one second hole, wherein said first pin is to be fitted in said first hole, without clearance between said first pin and said first hole, and wherein said at least one second pin is to be introduced in said at least one second hole, with clearance between said at least one second pin and said at least one second hole in said elongated direction.

2. The image recording apparatus according to claim 1, comprising a tray assembly including a plurality of supporting trays each of which consists of said supporting tray, such that said plurality of supporting trays each supporting said plurality of annular protrusions are arranged in the supporting-tray width direction;

wherein said head assembly includes a plurality of head frames each of which consists of said head frame, such that said plurality of head frames each supporting said plurality of recording heads are arranged in the supporting-tray width direction.

3. The image recording apparatus according to claim 1, comprising a conveyor configured to convey the recording medium in a recording-medium conveying direction while the image is being recorded on the recording medium, wherein said first-pin-located portion of said supporting tray is located in the center of said supporting tray in a direction which is parallel to said opening surface plane and which is perpendicular to the recording-medium conveying direction.

4. The image recording apparatus according to claim 1, wherein each of said annular protrusions cooperates with a corresponding one of said nozzle opening surfaces and said supporting tray, to define an enclosed space upon contact said each of said annular protrusions with said head assembly.

5. The image recording apparatus according to claim 1, wherein said head frame has a plurality, of through-holes located in respective positions in which said recording heads are positioned such that each of said nozzle opening surfaces is exposed through an opening of a corresponding one of said through-holes.

6. The image recording apparatus according to claim 1, wherein said first pin-located portion is a central portion of said supporting tray.

7. The image recording apparatus according to claim 1, wherein said at least one second pin consists of a plurality of second pins located in respective second-pin-located portions each of which consists of said second-pin-located portion, and wherein said second-pin-located portions are symmetrical, with respect to said first-pin-located portion.

8. The image recording apparatus according to claim 1, wherein said at least one second hole is distant from said first hole in a nozzle-opening-surface longitudinal direction in which said nozzle opening surfaces are elongated, and wherein said at least one second hole is elongated in said nozzle-opening-surface elongated direction.

9. The image recording apparatus according to claim 1, wherein said supporting tray is elongated in the supporting-tray longitudinal direction, and wherein said at least one second pin consists of a plurality of second pins located in end portions of said supporting tray that are opposite to each other in the supporting-tray longitudinal direction.

10. The image recording apparatus according to claim 1, wherein said first pin has a distal end that is positioned relative to a distal end of each of said annular protrusions, such that a distance between said distal end of said first pin and said opening surface plane is smaller than a distance between said distal end of each of said annular protrusions and said opening surface plane when said non-contact state is being established.

11. The image recording apparatus according to claim 1, wherein each of said first and second pins has a distal end that is positioned relative to a distal end of each of said annular protrusions, such that a distance between said distal end of each of said first and second pins and said opening surface plane is smaller than a distance between said distal end of each of said annular protrusions and said opening surface plane when said non-contact state is being established.

12. The image recording apparatus according to claim 1, wherein said at least one second hole is adjacent, in said opening surface plane, to a corresponding one of said nozzle opening surfaces.

13. The image recording apparatus according to claim 1, wherein said first pin has a higher hardness than that of each of said annular protrusions.

14. The image recording apparatus according to claim 1, wherein each of said first and second pins has a higher hardness than that of each of said annular protrusions.

15. The image recording apparatus according to claim 1, wherein said annular protrusions, said supporting tray and said first and second pins cooperate to constitute a cap unit, which is formed by a double injection molding such that said annular protrusions are made of a material while said supporting tray and said first and second pins are made of another material.

16. The image recording apparatus according to claim 1, further comprising a seal member that is attached to one of said first pin and said first hole and/or a seal member that is attached to one of said second pin and said second hole, such that a gap between said first pin and hole and/or a gap between said second pin and hole are sealed when said contact state is being established.

17. The image recording apparatus according to claim 1, wherein said first pin is fitted in said first hole without clearance between said first pin and said first hole, in said contact state in which said annular protrusions are in contact with said head assembly, and wherein said at least one second pin is introduced in said at least one second hole with clearance between said at least one second pin and said at least one second hole in said elongated direction, in said contact state.

* * * * *